US011613942B2

(12) United States Patent
Slaughter, Jr. et al.

(10) Patent No.: US 11,613,942 B2
(45) Date of Patent: Mar. 28, 2023

(54) TORQUE-DEPENDENT OSCILLATION OF A DUAL-PIPE INNER SECTION

(71) Applicant: The Charles Machine Works, Inc., Perry, OK (US)

(72) Inventors: Greg L. Slaughter, Jr., Perry, OK (US); Aleksander S. Wolfe, Stillwater, OK (US); Kyle D. James, Perry, OK (US)

(73) Assignee: The Charles Machine Works, Inc., Perry, OK (US)

( * ) Notice: Subject to any disclaimer, the term of this patent is extended or adjusted under 35 U.S.C. 154(b) by 0 days.

(21) Appl. No.: 17/335,895

(22) Filed: Jun. 1, 2021

(65) Prior Publication Data

US 2021/0285293 A1 Sep. 16, 2021

Related U.S. Application Data

(63) Continuation-in-part of application No. 16/299,903, filed on Mar. 12, 2019, now Pat. No. 11,053,756.

(60) Provisional application No. 63/033,245, filed on Jun. 2, 2020, provisional application No. 62/641,572, filed on Mar. 12, 2018.

(51) Int. Cl.
*E21B 19/16* (2006.01)
*E21B 7/04* (2006.01)

(52) U.S. Cl.
CPC ..... *E21B 19/166* (2013.01); *E21B 7/046* (2013.01)

(58) Field of Classification Search
CPC ..... E21B 7/046; E21B 19/16; E21B 19/165; E21B 19/166; E21B 44/00
See application file for complete search history.

(56) References Cited

U.S. PATENT DOCUMENTS

| | | | | |
|---|---|---|---|---|
| 4,444,273 | A * | 4/1984 | Ruby | E21B 19/166 173/180 |
| 7,216,724 | B2 | 5/2007 | Self et al. | |
| 7,594,540 | B2 * | 9/2009 | Koithan | E21B 21/02 166/380 |
| 7,628,226 | B2 | 12/2009 | Mitchell et al. | |
| 7,987,924 | B2 * | 8/2011 | Mitchell | E21B 19/165 166/380 |
| 9,598,905 | B2 | 3/2017 | Van Zee et al. | |
| 9,719,314 | B2 | 8/2017 | Lane | |
| 9,765,574 | B2 | 9/2017 | Slaughter, Jr. et al. | |
| 10,012,041 | B2 * | 7/2018 | Lane | E21B 19/166 |
| 10,605,016 | B2 | 3/2020 | Thiemann | |
| 10,711,520 | B2 * | 7/2020 | Langenfeld | E21B 17/046 |
| 11,053,756 | B2 * | 7/2021 | Slaughter, Jr. | E21B 19/166 |

(Continued)

*Primary Examiner* — Kenneth L Thompson
(74) *Attorney, Agent, or Firm* — Tomlinson McKinstry, P.C.

(57) ABSTRACT

A method for building a dual-member drill string comprising an inner drill string and an outer drill string. Inner pipe sections are connected using non-threaded connections, while outer pipe sections are connected using threaded connections. A new inner pipe section is rotated in a first direction until the inner pipe section applies torque to the existing inner pipe string. If the magnitude of the torque applied to the inner pipe string exceeds a pre-determined threshold value, the inner pipe section is automatically rotated in an opposite second direction. The inner pipe section rotates between opposite directions, once torque is sensed in each direction, until the inner pipe section is coupled to the inner pipe string.

21 Claims, 18 Drawing Sheets

(56) References Cited

U.S. PATENT DOCUMENTS

| | | | | |
|---|---|---|---|---|
| 2011/0278065 | A1* | 11/2011 | Mitchell | E21B 7/046 175/27 |
| 2012/0255779 | A1* | 10/2012 | Mitchell | E21B 19/165 175/27 |
| 2014/0144707 | A1* | 5/2014 | Hartke | E21B 15/006 175/57 |
| 2018/0179862 | A1 | 6/2018 | Wolfe et al. | |
| 2018/0313171 | A1 | 11/2018 | Vos et al. | |

* cited by examiner

TORQUE-DEPENDENT OSCILLATION OF A DUAL-PIPE INNER SECTION

SUMMARY

The present invention is directed to a method for adding a pipe section to a drill string. The pipe section comprises an inner pipe section and an outer pipe section, and the drill string comprises an inner pipe string and an outer pipe string. The method comprises the steps of attaching the pipe section to a carriage that is adapted to advance and rotate the pipe section, and aligning an end of the inner pipe section with an end of the inner pipe string. The method further comprises the steps of advancing the end of the inner pipe section towards the end of the inner pipe string, and rotating the inner pipe section in a first direction until the inner pipe section applies a first torque to the inner pipe string. The method further comprises the step of measuring a magnitude of the first torque, and if the measured magnitude of the first torque exceeds a predetermined threshold value, rotating the inner pipe section in a second direction opposed to the first direction.

The present invention is also directed to another method for adding a pipe section to a drill string. The pipe section comprises an inner pipe section and an outer pipe section, and the drill string comprises an inner pipe string and an outer pipe string. The method comprises the steps of attaching the pipe section to a carriage that is adapted to advance and rotate the pipe section, and advancing the pipe section towards an end of the drill string until the inner pipe section is in contact with the inner pipe string and the outer pipe section is in contact with the outer pipe string. The method further comprises the steps of applying a first torque to the outer pipe section that causes its rotation in a first direction. The first torque having a magnitude sufficient to produce interference between the outer pipe section and the outer pipe string. The method further comprises the steps of measuring the magnitude of the first torque, and stopping rotation of the pipe section if the magnitude of the first torque exceeds a predetermined threshold value.

DETAILED DESCRIPTION

Figure 1:
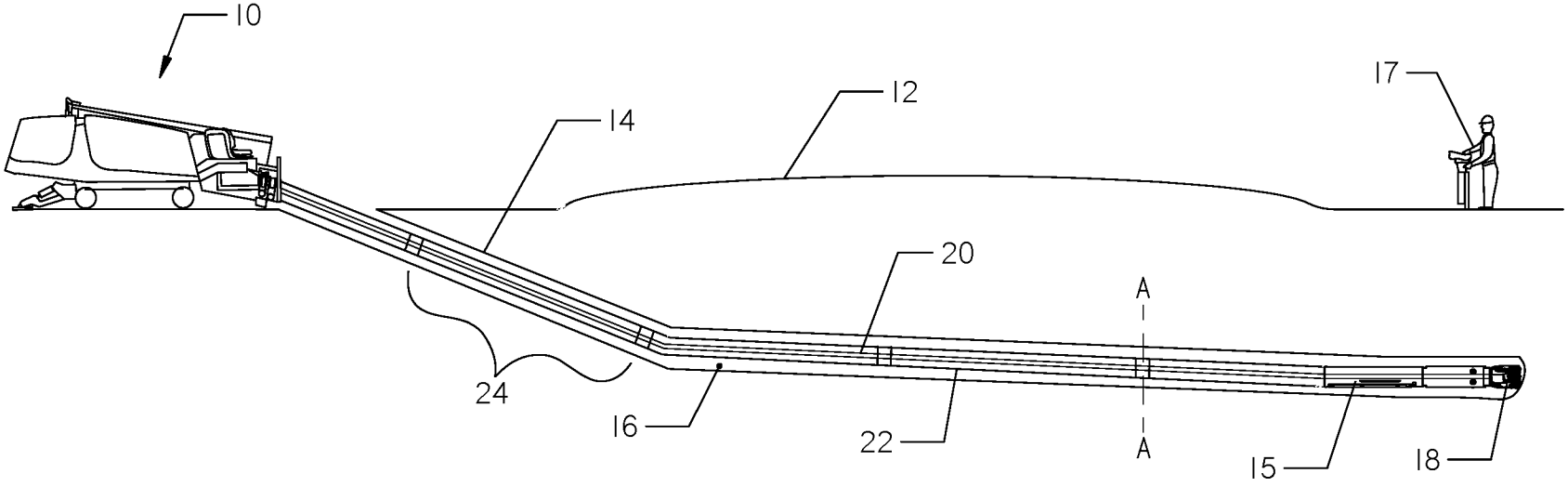
FIG. 1 is an illustration of a horizontal directional drilling operation.

Turning now to the figures, FIG. 1 shows a horizontal directional drilling machine 10 positioned at a ground surface 12. Horizontal directional drilling machines are used to replace underground utilities with minimal surface disruption. In operation, the machine 10 drills a borehole 14 underground using a drill string 16 attached to a drill bit 18. A beacon is included in the drill string 16 within a beacon housing 15. An operator tracks the location of the beacon underground using an above-ground tracker 17.

Figure 4:
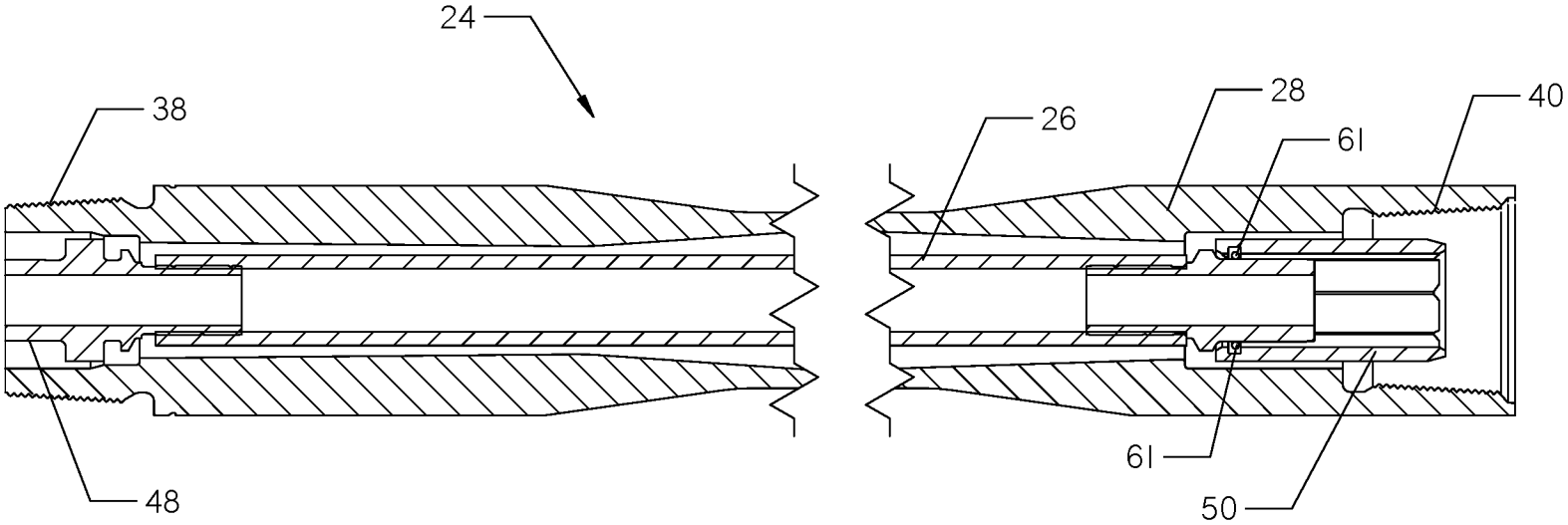
FIG. 4 is a longitudinal cross-sectional view of a dual-member pipe section.
Figure 12:
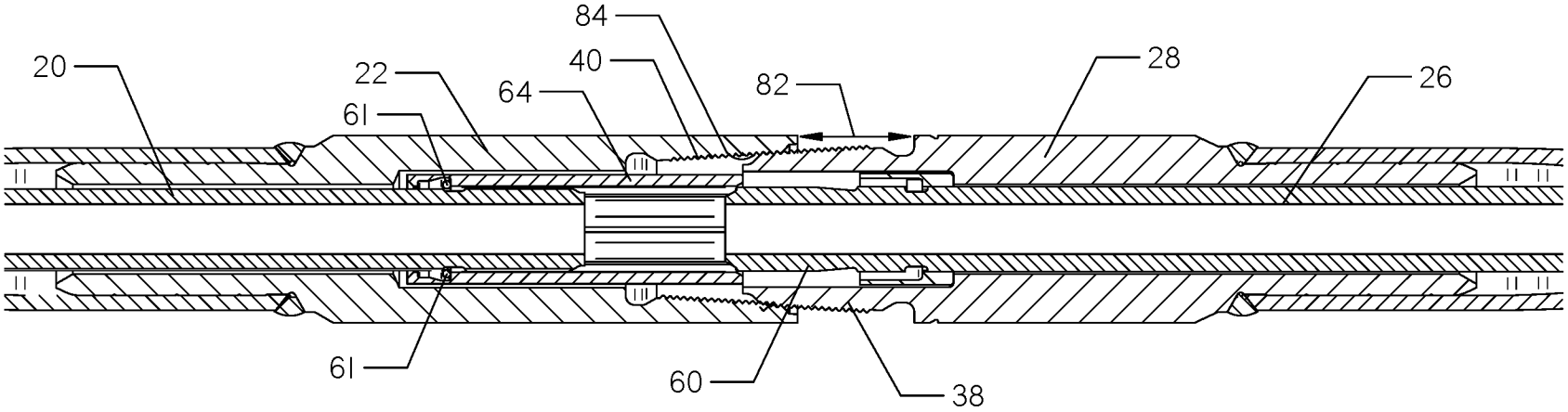
FIG. 12 is a longitudinal cross-sectional view of dual-member pipe sections in the process of being connected together.

With reference to FIGS. 1, 4 and 12, the drill string 16 is a dual-member drill string that comprises an elongate inner pipe string 20 and an elongate outer pipe string 22. The drill string 16 is made of dual-member pipe sections 24 attached end-to-end. Each pipe section 24 comprises an inner pipe section 26 and an outer pipe section 28, as shown in FIGS. 4 and 12.

The dual-member drill string 16 is formed by assembling the inner string 20 and the outer string 22. The inner string 20 extends within the outer string 22, which is formed from a series of outer pipe sections 28 arranged in end-to-end engagement. Preferably, each adjacent pair of outer pipe sections 28 is coupled with a torque-transmitting threaded connection. The inner string 20 is formed of a series of inner pipe sections 26 arranged in end-to-end engagement. Preferably, each adjacent pair of inner pipe sections 26 is coupled with a torque-transmitting non-threaded connection. Adjacent inner pipe sections 26 have a "slip-fit" connection. A non-threaded connection for the inner pipe sections 26 permits swifter assembly of the drill string 16 than if a threaded connection is used.

In operation, the inner pipe string 20 is rotatable independently of the outer pipe string 22. The inner pipe string 20 rotates the drill bit 18, while the outer pipe string 22 steers the drill bit. Steering of the drill bit 18 is accomplished using a steering mechanism incorporated into the outer surface of the outer pipe string 22. The steering mechanism deflects the drill string 16 and drill bit 18 in the desired direction. Steering mechanisms known in the art are deflection shoes or bent subs. When drilling straight, both the inner and outer pipe string 20 and 22 rotate. When steering, only the inner pipe string 20 rotates.

Figure 2:
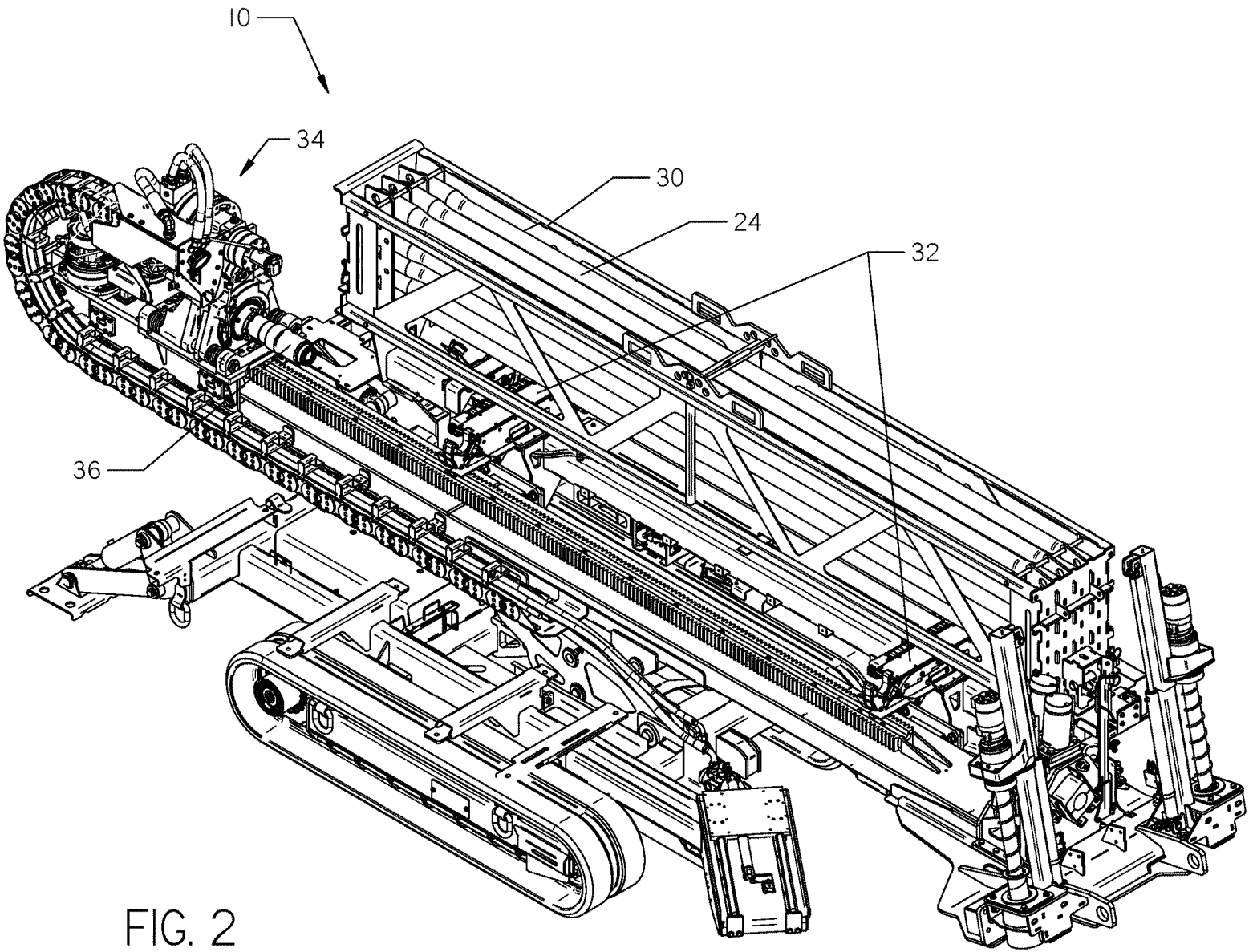
FIG. 2 is a right side perspective view of the horizontal directional drilling machine shown in FIG. 1. The operator station and engine housing have been removed for clarity.

Turning to FIG. 2, the individual pipe sections 24 are stored in a pipe box 30 supported on the machine 10. A pipe handling assembly 32 moves the pipe sections 24 between the pipe box 30 and a carriage 34. The carriage 34 moves laterally along its frame 35. The carriage 34 attaches each pipe section 24 to the drill string 16 and advances the drill string forward underground.

Figure 3:
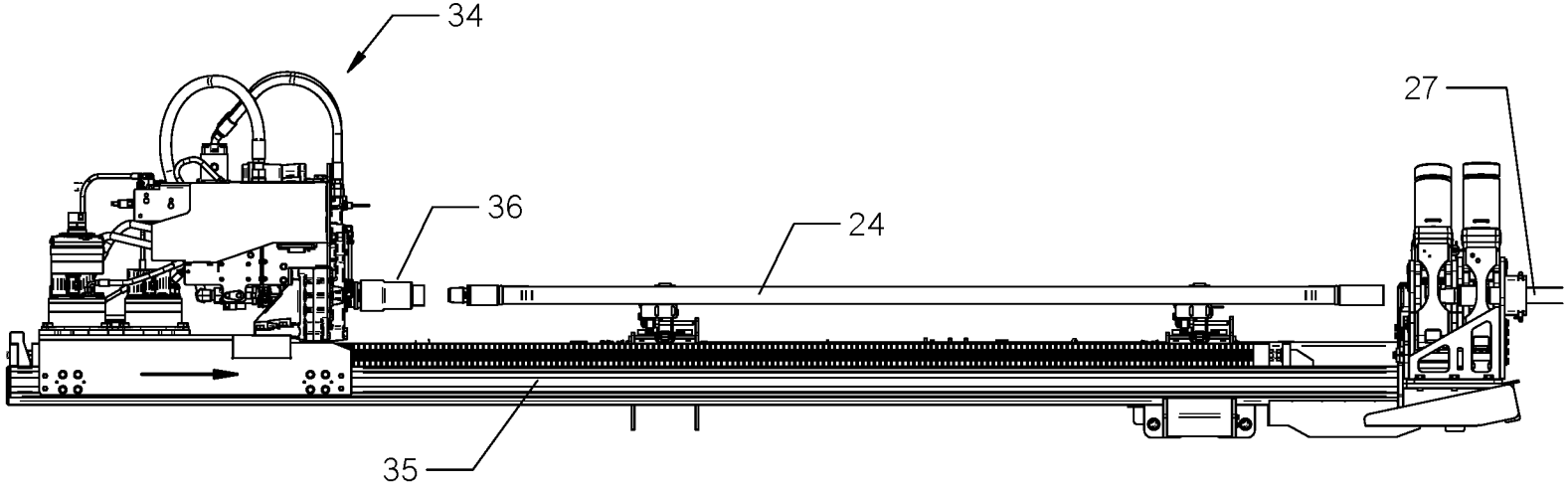
FIG. 3 is a right side elevational view of a carriage used with the machine shown in FIG. 2. A dual-member pipe section is shown in-line with a spindle on the carriage and in-line with an end of a drill string.

Turning to FIG. 3, prior to attaching a pipe section 24 to the drill string 16, the pipe section 24 must first be attached to a dual-member spindle 36 included in the carriage 34. The spindle 36 comprises an inner pipe section having a non-threaded end and an outer pipe section having a threaded end. The spindle 36 is attached to a pipe section 24 in the same manner as a pipe section 24 is attached to the drill string 16. The spindle 36 rotates both the inner and outer pipe section 26 and 28 so that each section may be attached to a corresponding section at an end 27 of the drill string 16.

Figure 5:
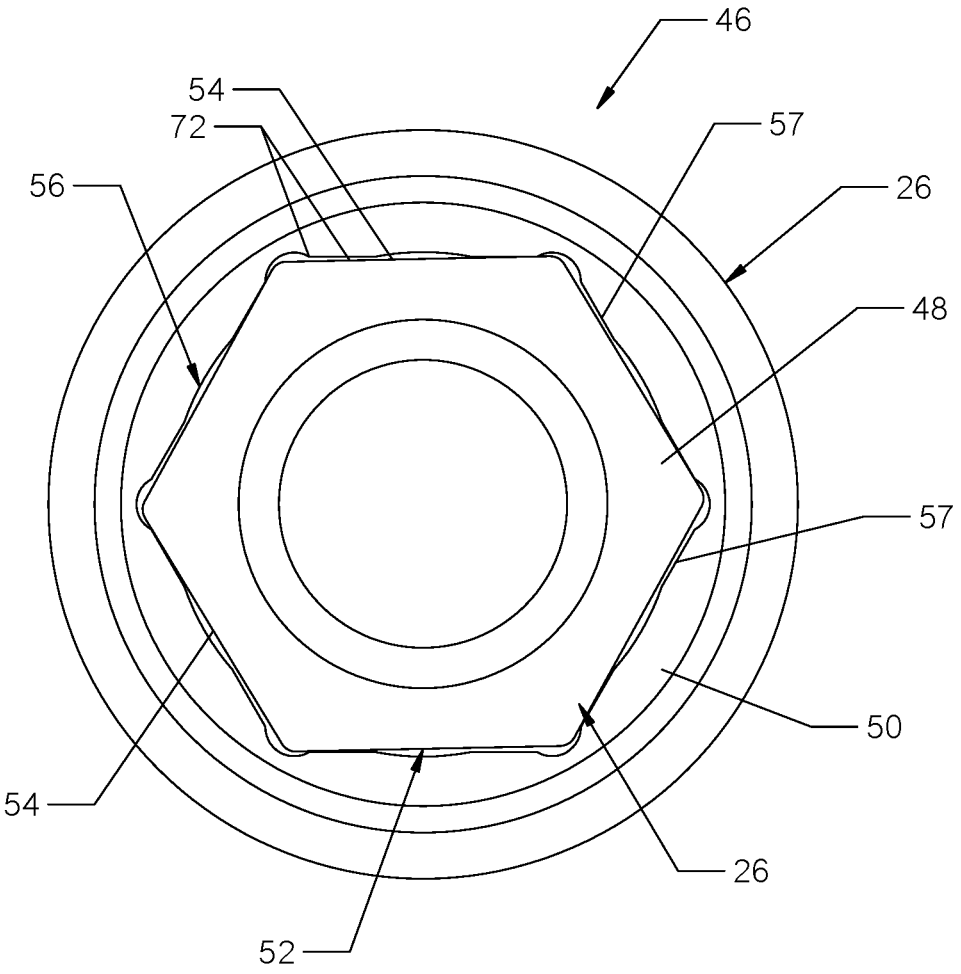
FIG. 5 is a cross-sectional view of an inner pipe string connection shown in FIG. 1, taken along line A-A.
Figure 7:
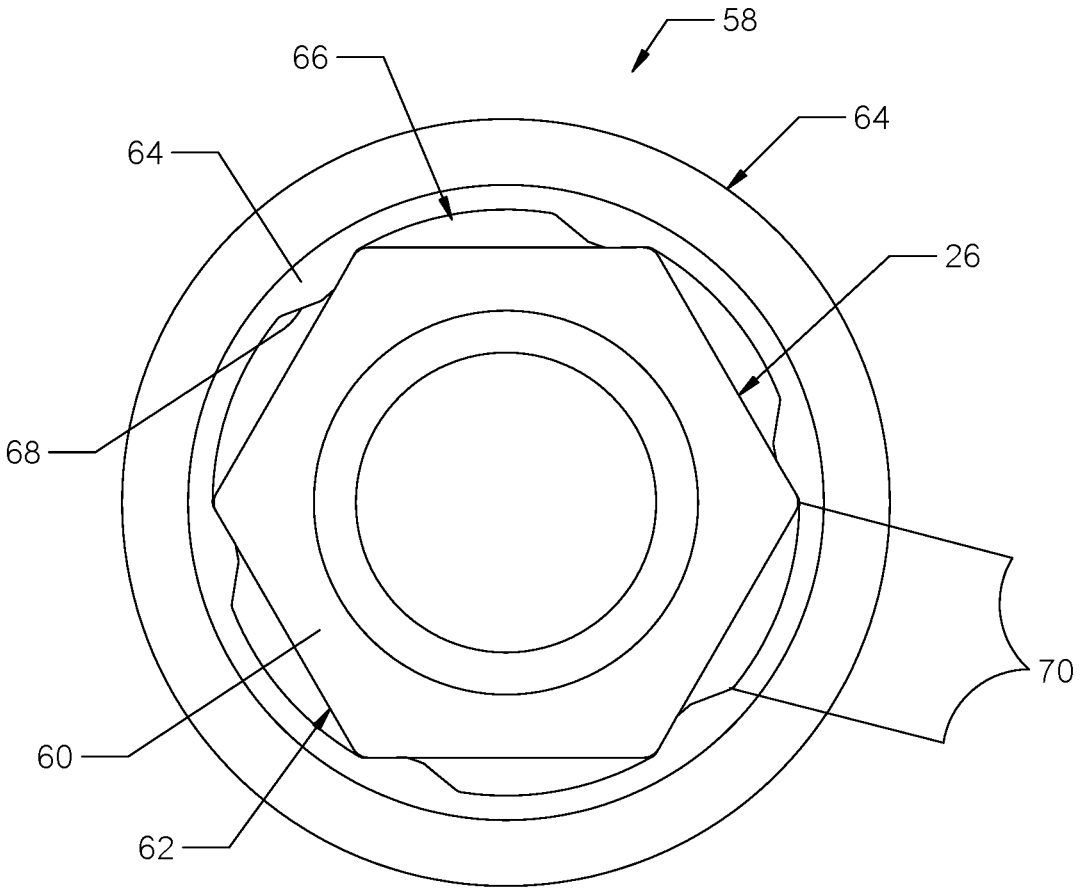
FIG. 7 is a cross-sectional view of an alternative embodiment of an inner pipe string connection shown in FIG. 1, taken along line A-A. In one embodiment of the invention, this is referred to as the operating torque-transmitting position.

With reference to FIGS. 4, 5, 7 and 12, each outer pipe section 28 has a threaded male end 38 and an opposed threaded female end 40. FIGS. 4 and 5 show an inner pipe section 26 having a non-threaded pin end 48 and an opposed non-threaded box end 50. FIGS. 7 and 12 show inner pipe sections 26 having a non-threaded pin end 60 and an opposed non-threaded box end 64.

Each of the box ends 50 and 64 may be removably attached to an end of an inner pipe section 26 via a plurality of fasteners 61, as shown in FIGS. 4 and 12. In alternative embodiments, each of the box ends may be welded to or otherwise integrally formed on an end of an inner pipe section. Each of the pin ends 48 and 60 may be welded to or otherwise integrally formed on an end of an inner pipe section 26, as shown in FIGS. 4 and 12. In alternative embodiments, the inner pipe section may have a polygonal outer profile formed along its length from end-to-end.

Figure 6:
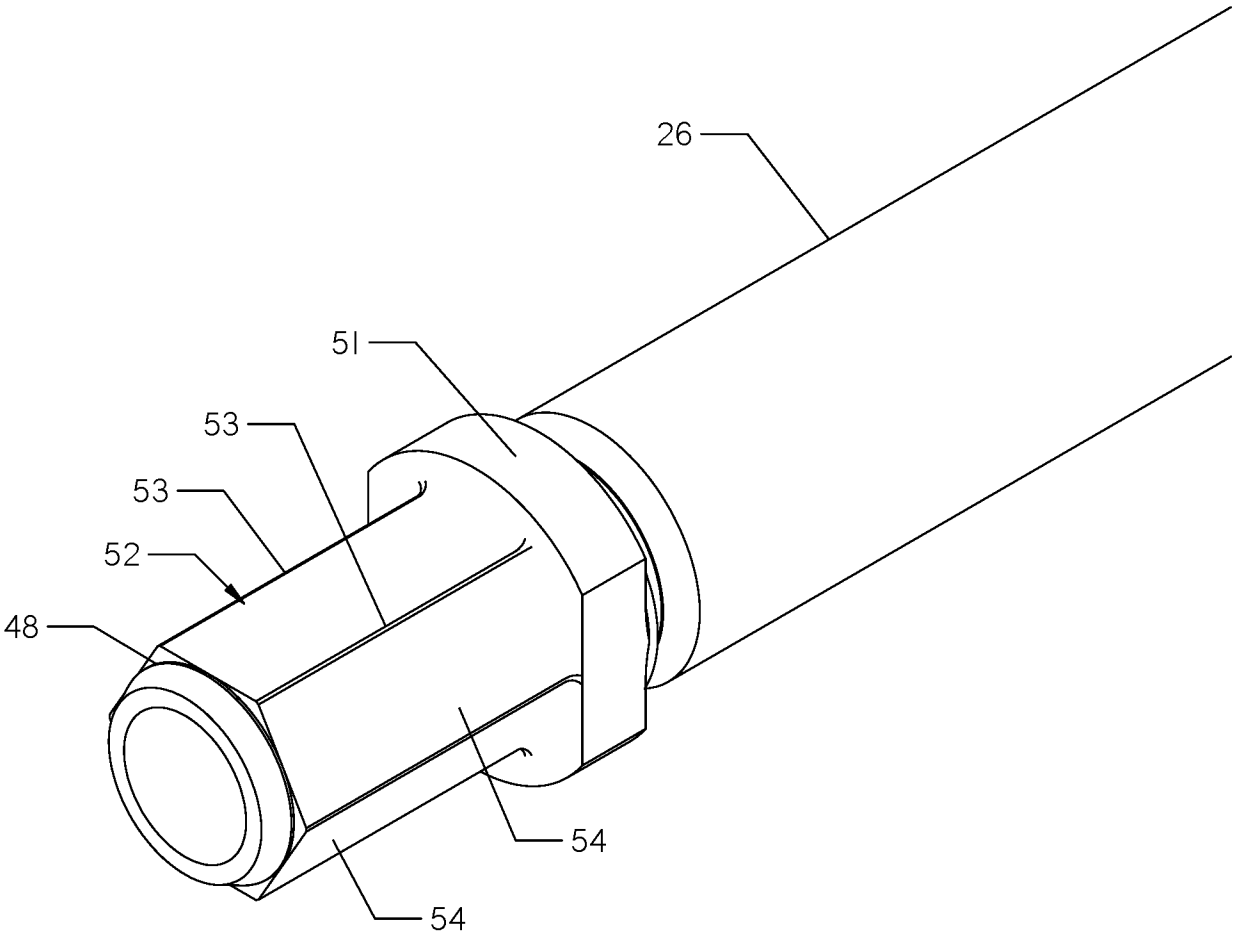
FIG. 6 is a perspective view of a pin end of an inner pipe section shown in FIGS. 4 and 12.

With reference to FIG. 5, a non-threaded connection 46 between adjacent inner pipe sections 26 is formed by installation of the pin end 48 into the box end 50. The pin end 48 has a polygonal outer profile 52 made of a plurality of adjacent flat sides 54, as shown in FIG. 6. An edge 53 is formed at the connection between adjacent flat sides 54. An annular shoulder 51 may be formed on the pin end 48 for preventing axial movement of the inner pipe section 26 within the outer pipe section 28.

Continuing with FIG. 5, the box end 50 has a central opening having a polygonal inner profile 56 complementary to the outer profile 52 of the pin end 48. The profile 52 is formed by a plurality of adjacent side walls 57. Torque is transmitted between adjacent pipe sections 26 by engagement of the flat sides 54 with the walls 57. When connecting adjacent inner pipe sections 26, the complementary profiles 52 and 56 must be adequately aligned so the pin end 48 successfully installs within the box end 50. If misaligned, the ends 48 and 50 can be damaged as they are forced together by the carriage 34.

Figure 8:
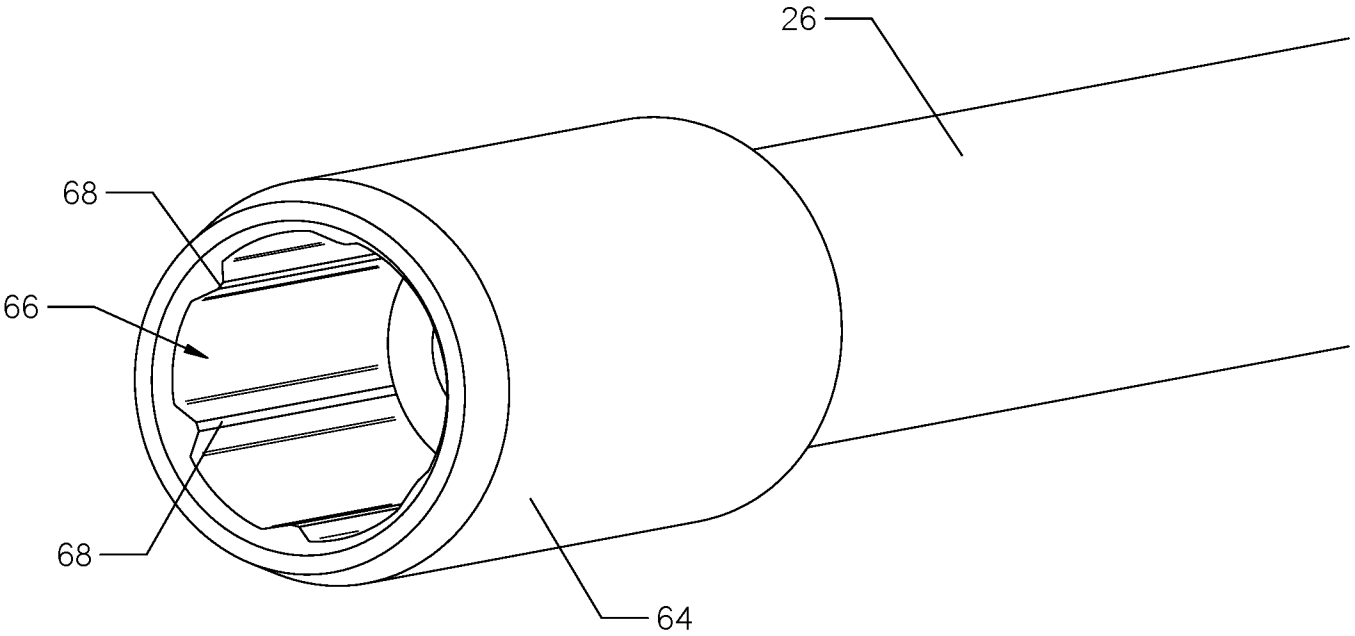
FIG. 8 is a perspective view of a box end of an inner pipe section shown in FIG. 12.

With reference to FIG. 7, an alternative embodiment of a non-threaded connection 58 between adjacent inner pipe sections 26 is shown. The pin end 60 has a polygonal outer profile 62, like that shown in FIG. 6. The box end 64 has a central opening having a polygonal inner profile 66. In contrast to the box end 50, the inner profile 66 of the box end 64 is not complementary to the outer profile 62 of the pin end 60. Instead, a plurality of projections 68 are formed on the inner profile 66 of the box end 64, as shown in FIG. 8. The projections 68 engage with the outer profile 62 of the pin end 60 such that torque may be transmitted between adjacent inner pipe sections 26.

Figure 10:
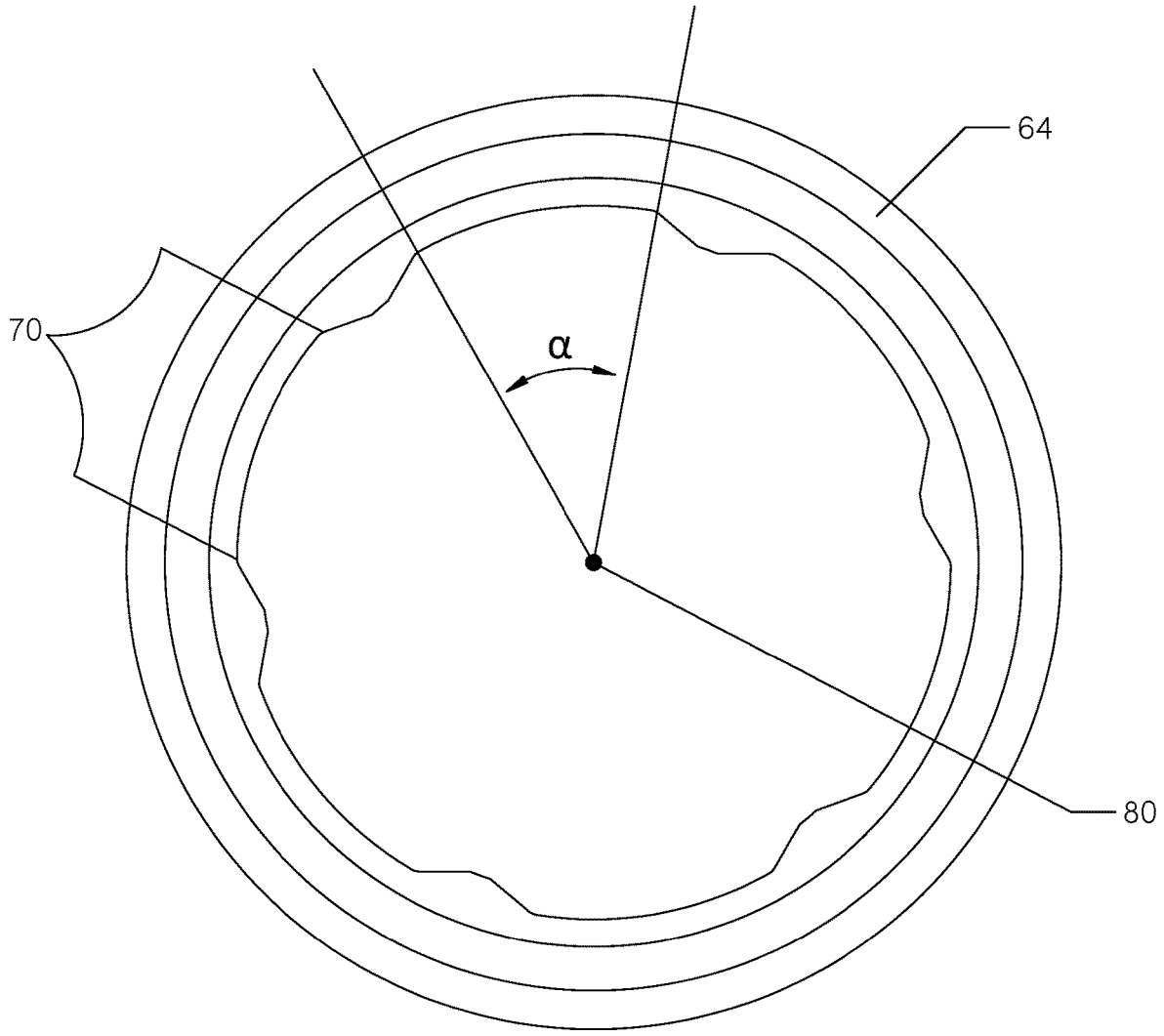
FIG. 10 is the view of FIG. 7 with the pin end removed.

Continuing with FIG. 7, a plurality of windows 70 are formed between adjacent projections 68. Each of the windows 70 is a sector within which adjacent coupled pipe sections 26 may rotate relatively, without encountering any major torsional resistance. The size of each window 70 is denoted by the central angle $\alpha$ of the sector, as shown in FIG. 10. The non-threaded connection 58 allows for significantly more tolerance to the required alignment than the connection 46. However, if the pin end 60 is not properly aligned with the windows 70, misalignment of the ends 60 and 64 and resulting damage will still occur when the ends are forced together by the carriage 34.

Figure 11:
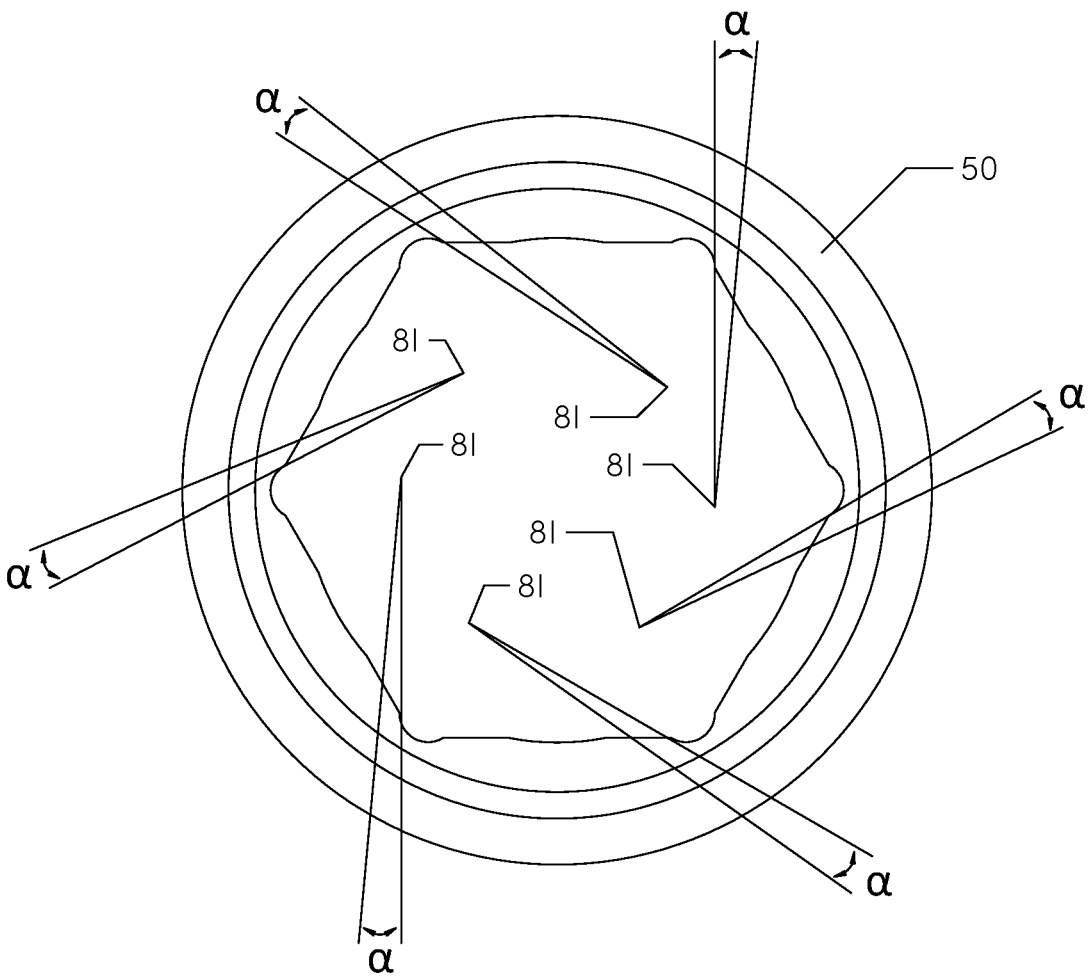
FIG. 11 is the view of FIG. 5 with the pin end removed.

Turning back to FIG. 5, the box end 50 of the connection 46 may also have a plurality of windows 72. The windows 72 are each a small gap that exists between the flat sides 54 and the side walls 57. However, the windows 72 are significantly smaller than those in the box end 64 of the connection 58. Each of the windows 72 is a sector within which adjacent coupled pipe sections 26 may rotate relatively, without encountering any major torsional resistance. The size of each window 72 is denoted by the central angle $\alpha$ of the sector, as shown in FIG. 11.

With reference to FIGS. 5 and 7, one way to prevent misalignment of the ends 48 and 50 or 60 and 64 is to "dither" or "oscillate" the inner pipe section 26 as it is being connected to the inner pipe string 20. The dither or oscillating technique involves rotating the inner pipe section 26 in opposed clock directions for a set time period until a torque-transmitting connection is established between the inner pipe section 26 and the inner pipe string 20. For example, the inner pipe section 26 may be rotated in a first direction for one second and then rotated in a reverse second direction for one second. Alternatively, the inner pipe section 26 may be rotated through a set angular distance before rotating in the reverse direction. The inner pipe section 26 cycles between rotating in the first and second directions until a torque-transmitting connection between adjacent pipe sections 26 is established. Once established, the ends 48 and 50 or 60 and 64 may be forced together by the carriage 34. This technique is also used when connecting a pipe section 24 to the dual-member spindle 36, as shown in FIG. 3. Likewise, this technique is also used when connecting the spindle 36 directly to the drill string 16. The spindle 36 is connected directly to the drill string 16 when removing a pipe section 24 from the drill string 16.

While the dither or oscillating technique has improved the reliability of making aligned connections 46 or 58, the technique is known to cause wear on the connections. Wear is caused because the inner pipe section 26 continues to rotate until the set time period has expired or the set angular distance has been reached. Such rotation continues regardless of whether a proper torque transmitting connection 46 or 58 has already been established. Continued rotation means continued torque and stress applied to the connections 46 or 58.

Another issue encountered when making the connections 46 or 58 is the magnitude of the torque applied to the inner pipe section 26 being added to the inner pipe string 20. The carriage 34 is adapted to provide enough torque to rotate the entire drill string 16. However, significantly less torque is required to connect a new inner pipe section 26 to the inner pipe string 20. For example, 2,000 pounds-feet of torque may be required to rotate the drill string 16; whereas, 200 pounds-feet of torque may be required to rotate a single inner pipe section 26.

If 2,000 pounds-feet of torque is applied to the non-threaded connections 46 or 28, the connections may become damaged if the ends 48 and 50 or 60 and 64 are not fully engaged or are misaligned. Thus, it is known in the art to limit the magnitude of torque used to connect a new inner pipe section 26 to the inner pipe string 20 to only the magnitude of torque required to make the connection 46 or 58. However, wear is still imposed on the connection 46 or 58 because the inner pipe section 26 continues to rotate until the set time period has expired or the set distance has been reached.

The present connection method limits wear to the connections 46 or 58 by substituting a cyclic timed oscillation or oscillation through a set angle with a torque-dependent oscillation. With a torque-dependent oscillation, the direction of rotation of the inner pipe section 26 is automatically reversed once a desired magnitude of torque is measured within inner drill string 20. Thus, no excessive torque is applied to the connection 46 or 58.

Figure 9:
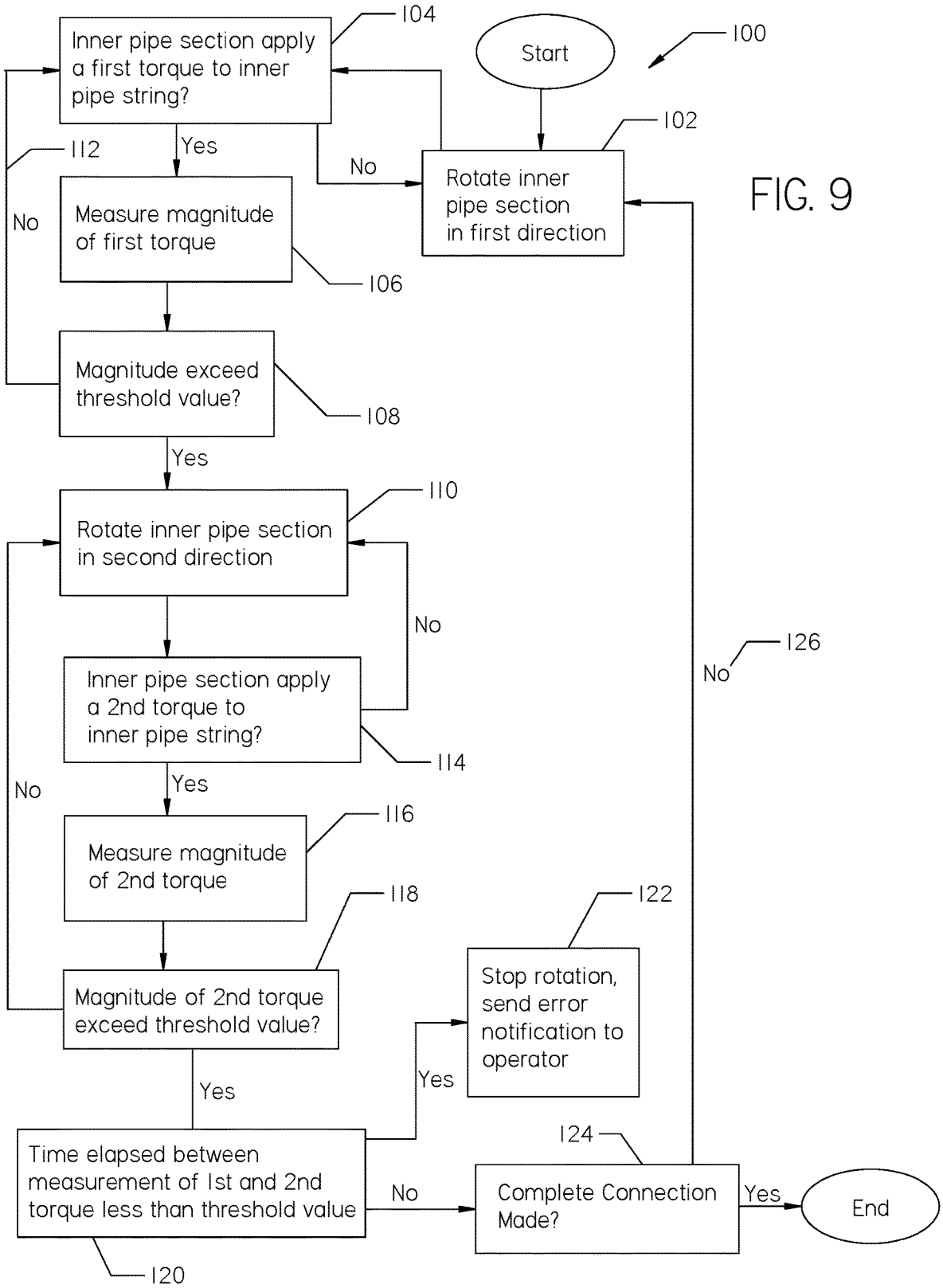
FIG. 9 is a flow chart describing a method for connecting an inner pipe section to an inner pipe string using torque activated oscillation.

Turning to FIG. 9, a torque dependent oscillation method 100 is detailed. The method 100 is described with reference to connecting an inner pipe section 26 to an inner pipe string 20. However, a skilled artisan will recognize that the same method may be used to attach the inner pipe section of the spindle 36 to an inner pipe section 26 or directly to the drill string 16. Before the method 100 starts, the pipe section 24 is first aligned and advanced toward the drill string 16. Once the inner pipe section 26 is immediately adjacent the inner pipe string 20, the method 100 may begin. The method 100 is described with reference to the connection 58, shown in FIG. 7.

To start, the inner pipe section 26 is slowly rotated in a first direction, as shown by step 102. The inner pipe section 26 is rotated until the polygonal outer profile 62 of the pin end 60 applies a first torque to the polygonal inner profile 66 of the box end 64, as shown by step 104. Once the first torque is applied, a sensor included in the machine 10 will measure the magnitude of the first torque, as shown by step 106. If the magnitude of first torque exceeds a predetermined threshold value, the inner pipe section 26 will automatically reverse direction and rotate in a second direction, as shown by steps 108 and 110. The first and second directions are opposite clock directions. If the magnitude of the first torque does not exceed the threshold value, the inner pipe section 26 will continue rotating in the first direction, as shown by step 112.

The predetermined threshold value may be the magnitude of torque required to establish a torque transmitting connection 58. For example, the value may be at least 200 pounds-feet. By automatically reversing rotation of the inner pipe section 26 once this value is measured, no excessive torque is applied to the connection 58.

With reference to FIG. 3, the threshold value may vary depending on whether the inner pipe section 26 is being connected to the spindle 36 or the inner pipe string 20. A lower magnitude of torque may be required to connect the inner pipe section 26 to the spindle 36 than is required to connect the inner pipe section 26 to the inner pipe string 20. The carriage 34 may comprise an encoder used to track the position of the carriage 34 along its frame 35. If the carriage 34 is within a zone where the inner pipe section 26 is connected to the spindle 36, the threshold value may be reduced.

Continuing with FIG. 9, if the threshold value is met and the direction of rotation is reversed, the inner pipe section 26 will continue to rotate in the second direction, as shown by step 110. The inner pipe section 26 will rotate in the second direction until the polygonal outer profile 62 of the pin end 60 applies a second torque to the polygonal inner profile 66 of the box end 64, as shown by step 114. Once the second torque is applied, a processor will measure the magnitude of the second torque, as shown by step 116. If the magnitude of the second torque exceeds the threshold value, the processor will analyze the time elapsed between measurement of the first and second torque, as shown by steps 118 and 120.

When rotation of the inner pipe section 26 is reversed, the pin end 60 will rotate through the windows 70, shown in FIG. 7. As described below, the time it takes for the inner pipe section 26 to rotate through the windows 70 can be determined and established as a threshold value. If the time elapsed between measurement of the first and second torque is less than the threshold value, a bad connection has likely been made. The sensor measures the elapsed time and the processor analyzes whether the elapsed time has met the threshold value, as shown by step 120.

The processor can be programmed to automatically stop rotation of the inner pipe section 26 if the time elapsed is less than the threshold value, as shown by step 122. The processor may also send an error notification to the operator if the threshold value is not met, as shown by step 122. The operator may then check the inner pipe section 26 for damage. If necessary, the operator may remove the inner pipe section 26 and start over. The processor may also log the event so that it may be diagnosed and analyzed, if desired. The processor may also automatically stop rotation of the outer pipe section 28 if the threshold value is not met.

Continuing with FIG. 9, if the time elapsed between measurement of the first and second torque is at or greater than the threshold value, a proper torque-transmitting connection is likely being established. The torque activated oscillation method 100 will continue until a proper torque-transmitting connection 58 has been established, as shown by steps 124 and 126. The inner pipe section 26, for example, may rotate twice in the first direction and twice in the second direction before a proper connection 58 is established. The same method 100 is used to make the connection 46, shown in FIG. 5.

After a proper torque-transmitting connection is established, any torsional resistance being applied to the inner pipe section 26 is preferably removed. The torsional resistance is removed in order to prevent unnecessary wear to the inner pipe section 26 as the outer connection is made. Torsional resistance is removed by rotating the inner pipe section 26 to an angular position that is intermediate the angular position of the inner pipe section 26 at the time the first and second torque were measured. Alternatively, the inner pipe section 26 may be rotated for a length of time equal to half of the threshold value of the elapsed time between measurement of the first and second torque. Once torsional resistance is removed from the inner pipe section 26, the end of the pipe section 26 may be brought completely together with an end of the inner pipe string 20.

With reference to FIG. 12, the outer pipe section 28 may start to thread onto the outer pipe string 22 as the method 100 is being performed. In alternative embodiments, the outer pipe section 28 may wait to start threading onto the outer pipe string 22 until the method 100 has been completed. Either way, the inner pipe section 26 and inner drill string 20 may be brought completely together as the outer pipe section 28 couples to the outer pipe string 22.

With reference to FIGS. 10 and 11, the size of each of the windows 70 and 72 is denoted by the central angle α of the sector. In the box end 64, the angle α is measured from a center point 80 of the box end, as shown in FIG. 10. In the box end 50, the angle α is measured from points 81 positioned around the interior of the box end, as shown in FIG. 11. The windows 70 shown in FIG. 10 have an angle α of 40°. In alternative embodiments, the angle α for the windows 70 may be between 20° and 40°. The windows 72 shown in FIG. 11 have an angle α of 5.7°. In alternative embodiments, the angle α for the windows 72 may be between 3.7° and 5.7°.

The time it takes the pin end 60 or 48 to rotate between adjacent windows 70 or 72 may be determined using the below equation:

$$\Delta = \frac{\alpha}{\theta * 6 * \frac{1}{n}}$$

In which, Δ is the expected time, in seconds, it will take for the inner pipe section 26 to rotate through the window 70 or 72. Such value may be referred to as the "window time". In which, α is the angle α for the windows 70 or 72, Θ is the rotational speed of the inner pipe section 26, in rotations per minute (rpm), and "6" is a constant that takes into account the conversion from rotations to degrees and the conversion from minutes to seconds.

Finally, "n" takes into account the number of areas along the inner pipe section 26 that may experience instances of no torsional resistance. One area this occurs is within the windows 70 or 72. Another area this may occur is between an inner pipe section 26 and its removably attached box end 50 or 64. The removable box end 50 or 64 may rotate relative to the inner pipe section 26 it is attached to. This relative rotation may provide instances where no torsional resistance is experienced between the box end 50 or 64 and the inner pipe section 26. Thus, an inner pipe section 26 with a removable box end 50 or 64 will have two areas that experience instances of no torsional resistance. In contrast, if the box end 50 or 64 is welded to or integral with the inner pipe section 26, there is no relative rotation between the inner pipe section 26 and its box end 50 or 64. Thus, only the windows 70 or 72 provide an area where no torsional resistance may occur.

The number of areas along the inner pipe section 26 that may experience instances of no torsional resistance also depends on whether the inner pipe section 26 is being connected to the spindle 36 or the drill string 16. If the inner pipe section 26 is being attached to the spindle 36 and has a removable box end 50 or 64, the inner pipe section will have two areas that may experience instances of no torsional resistance.

If the inner pipe section 26 is being connected to the inner drill string 20 and has a removable box end 50 or 64, the inner pipe section will have four areas that may experience instances of no torsional resistance. Two areas are found at the connection between the inner pipe section 26 and the spindle 36 and two areas at the connection between the inner pipe section 26 and the drill string 20. In contrast, if the box end 50 or 64 is welded to its pipe section 26, only one area is found at the connection between the inner pipe section 26 and the spindle 36, and one area at the connection between the inner pipe section 26 and the drill string 20.

Turning back to FIG. 10, the rotational speed of the inner pipe section 26 typically used to make the connection 58 is 25-30 rpm. Using this speed, a 40° angle α for the windows 70, and a "n" value of "2", the window time (Δ) is 0.44 to 0.54 seconds, according to the above equation. Thus, the time elapsed between measurement of the first and second torque should be at least 0.44 seconds. If the time elapsed is less than 0.44 seconds, a bad connection is likely being made. Therefore, the threshold value considered at step 120 in FIG. 9 may be at least 0.44 seconds.

Turning back to FIG. 11, the rotational speed of the inner pipe section 26 typically used to make the connection 46 is 60-90 rpm. Using this speed, and a 5.7° angle α for the windows 72, and a "n" value of "2", the window time (Δ) is 0.032 to 0.024 seconds, according to the above equation. Thus, the time elapsed between measurement of the first and second torque should be at least 0.024 seconds. If the time elapsed is less than 0.024 seconds, a bad connection is likely being made. Therefore, the threshold value considered at step 120 in FIG. 9 may be at least 0.024 seconds.

In alternative embodiments, step 120 in FIG. 9 may analyze the angular rotation of the inner pipe section 26, rather than analyze the time between torque measurements. A sensor or encoder may be used to measure the direction and angular rotation of the inner pipe section of the spindle 36. The processor may analyze the angle at which the inner pipe section 26 rotates between measurement of the first and second torque. If, for example, the window 70 has an angle α of 40°, the inner pipe section 26 should rotate 40° between measurement of the first and second torque. If the inner pipe section 26 rotates less than 40°, a bad connection is likely being made. Thus, a threshold value for the connection 58 at alternative step 120 may be at least 40°. For the connection 46, the threshold value at alternative step 120 may be at least 5.7°.

The number of inner pipe section 26 rotations in each direction may be limited by the time it takes the outer pipe section 28 to thread onto the outer pipe string 22. Thus, the number of times the inner pipe section 26 rotates in each direction may be controlled by controlling the speed at which the outer pipe section 28 connects to the outer pipe string 22.

Turning to FIG. 12, the time it takes to thread the outer connection depends on the length of a standoff 82 provided on the male end 38 of the outer pipe section 28. The standoff 82 is the distance between mating shoulders on a thread when the peaks of the male and female thread 38 and 40 begin to engage.

The preferred rotational speed of the outer pipe section 28 may be determined using the below equation:

$$\omega = \frac{L/P}{\Delta * n} * 60$$

In which, ω is the ideal rotational speed of the outer pipe section 28 in rpm, and "L" is the standoff 82, in inches. In which, "P" is the pitch of the thread, in inches, and Δ is the window time. In which, "n" is the number of desired rotation cycles of the inner pipe section 26. For example, if "4" is used in the equation, two cycles clockwise and two cycles counter-clockwise are accounted for. Finally, in which "60" is a constant for converting rotations per second into rpm.

Continuing with FIG. 12, if the inner pipe section 26 is rotated at 25 rpm, the box end 64 has a window time of 0.54 seconds. The standoff 82 shown in FIG. 12 is 1.66 inches. If "n" is 4, then the preferred rotation speed of the outer pipe section 28, according to the above equation, is 187 rpm. The above equation may also be rewritten to determine the number of possible rotation cycles for the inner pipe section 26 at different outer pipe section 28 rotation speeds.

The processor included in the machine 10 may be programmed to automatically make the above calculations based on the measurements of the chosen pipe sections and operator preferences. The operator preferences may vary throughout a single operation. If the preferences vary, the processor may continually update the calculations as new inputs are received.

Figure 13:
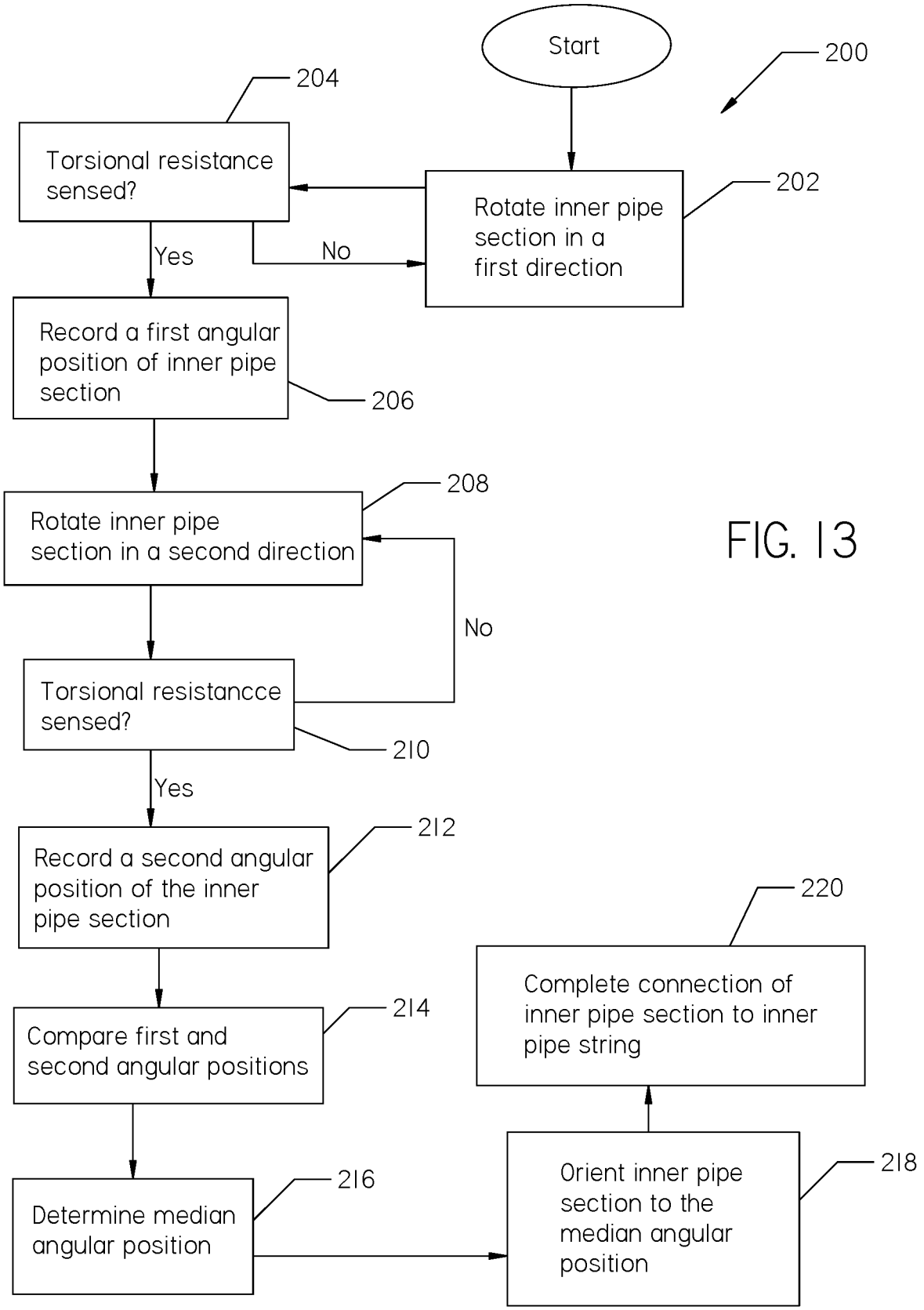
FIG. 13 is a flow chart describing an alternative method for connecting an inner pipe section to an inner pipe string.

With reference to FIG. 13, an alternative embodiment of a method 200 for making the connection 58 is shown. The method 200 searches for the ideal positioning of the pin end 60 within the box end 64. An ideal position may be important, because each inner pipe section 26 may experience some level of angular deflection to its polygonal profiles 62 and 66.

To start, the inner pipe section 26 is rotated in a first direction until a first torsional resistance is sensed, as shown by steps 202 and 204. Once sensed, a first angular position of the inner pipe section 26 is recorded, as shown by step 206. The inner pipe section 26 is then rotated in a second direction until a second torsional resistance is sensed, as shown by steps 208 and 210. Once sensed, a second angular position of the inner pipe section 26 is recorded, as shown by step 212. The processor compares the first angular position to the second angular position and determines a median angular position, as shown by steps 214 and 216. The inner pipe section 26 is then oriented at the median angular position, as shown by step 218. Once in the median angular position, the ends 60 and 64 are forced the remainder of the distance together, making the connection 58, as shown by step 220. The inner pipe string 20 may then be held stationary while the outer pipe section 28 is threaded onto the outer pipe string 22. Alternatively, the outer connection may be made at the same time as the connection 58. The same method 200 may be used to make the connection 46.

Figure 14:
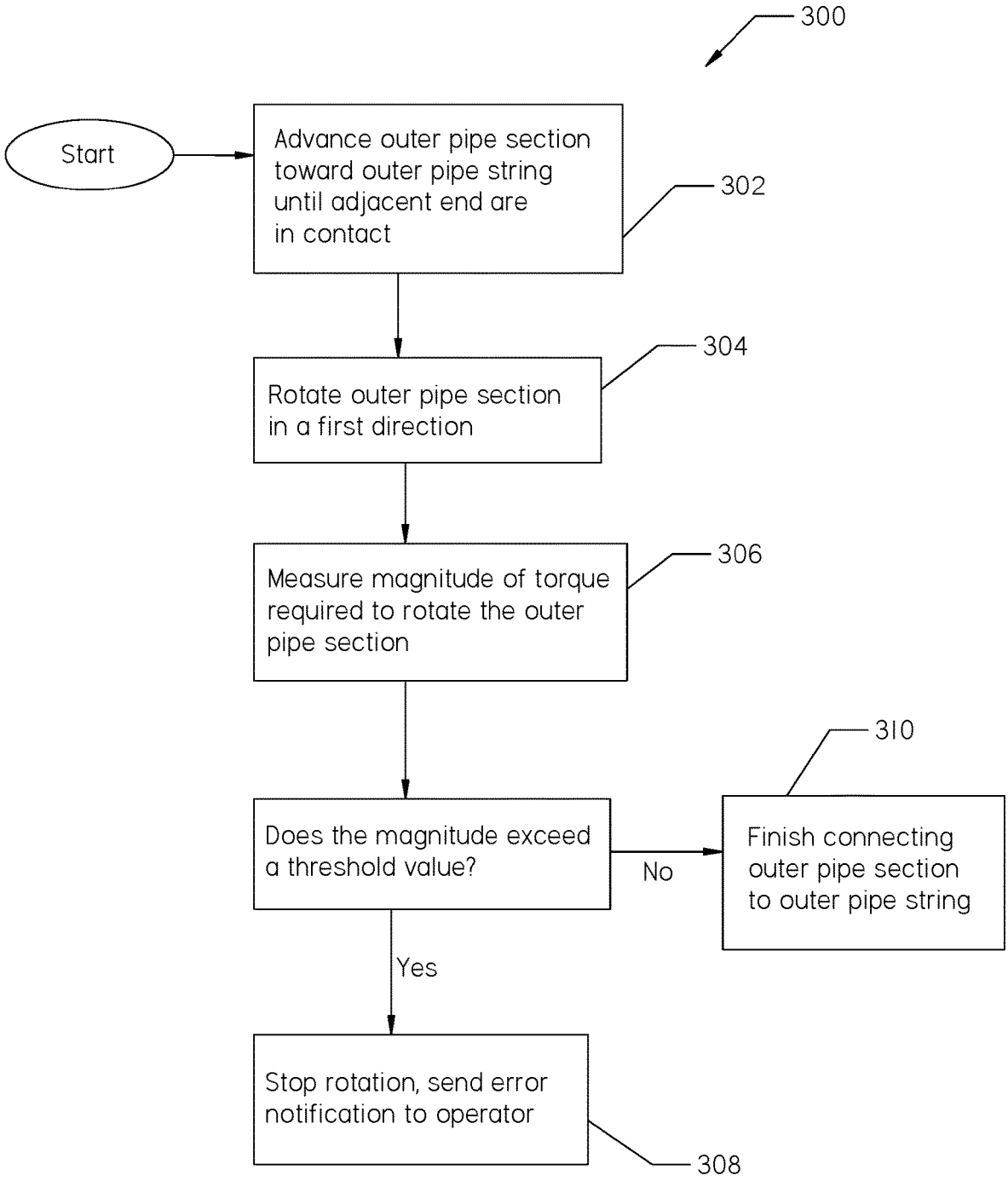
FIG. 14 is a flow chart describing a method for analyzing whether an inner pipe section is being properly connected to the inner pipe string.

Turning to FIG. 14, a method 300 for forming the connections 58 or 46 is shown. If a bad connection is starting to be made between the inner pipe section 26 and the inner pipe string 20, more torque is typically required to thread the outer pipe section 28 to the outer pipe string 22. Thus, the processor may analyze the magnitude of torque required to thread the outer pipe section 28 to the outer pipe string 22 as the inner connection is being made.

To start, the outer pipe section 28 is advanced towards the outer drill string 22 until the adjacent ends 38 and 40 are in contact with one another, as shown by step 302. The outer pipe section 28 is rotated in a first direction, as shown by step 304. The processor measures a magnitude of torque required to rotate the outer pipe section 28, as shown by step 306. If the magnitude of torque exceeds a predetermined threshold value, rotation of the outer pipe section 28 is stopped and an error notification is sent to the operator, as shown by step 308. The threshold value may be 1,000 pounds-feet. If the magnitude of torque does not exceed the threshold value, the outer connection may be completely made, as shown by step 310.

Figure 15:
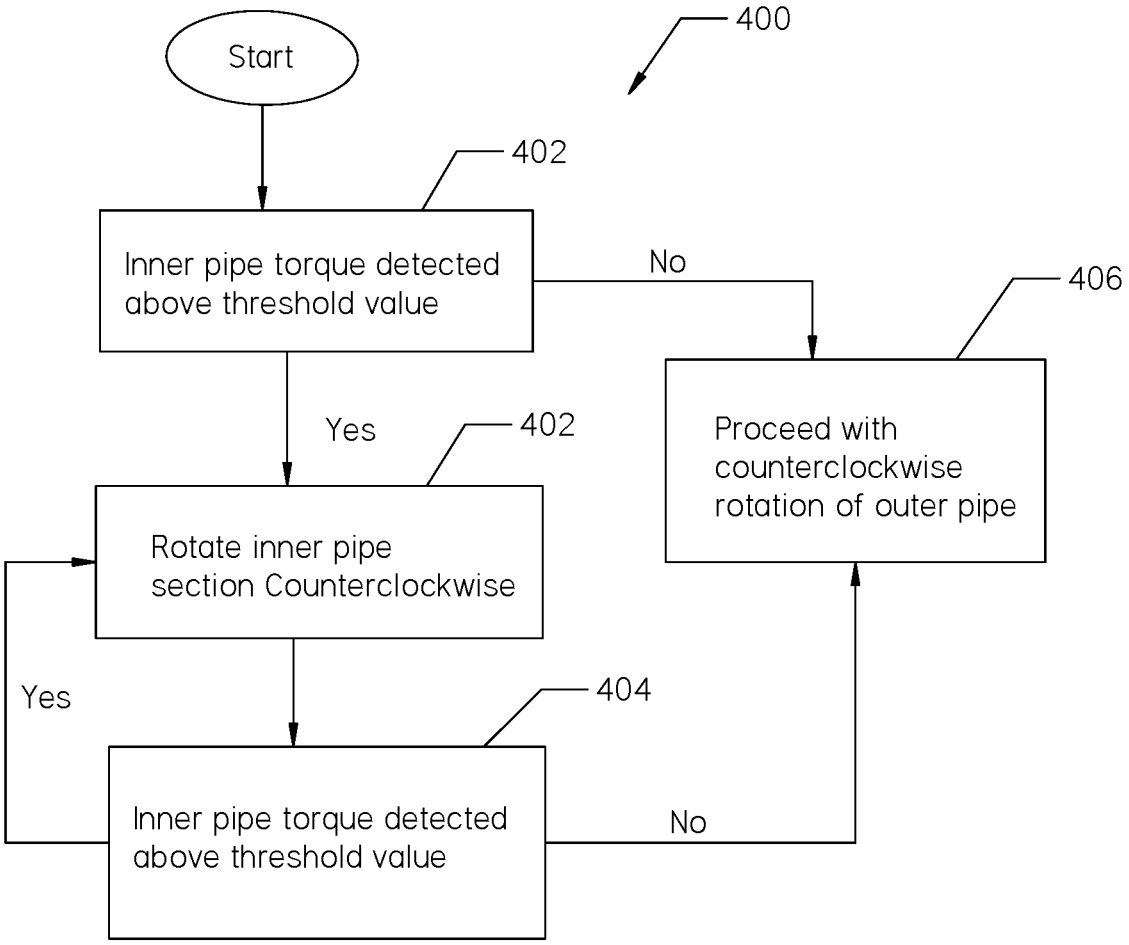
FIG. 15 is a flow chart describing a method for removing a pipe section from a drill string.

Turning to FIG. 15, a method 400 for removing a pipe section 24 from the drill string 16 is shown. Before removing a pipe section 24, it is ideal to remove any torsional resistance still being applied to the inner pipe string 20. Removing the torsional resistance prevents wear on the inner pipe sections 26 caused by separating each inner pipe section 26 when under a torqued load. The torsional resistance applied to the inner pipe section 26 may be removed by rotating the inner pipe section 26 in a counterclockwise direction. During drilling operations, the inner pipe section 26 is typically rotated in a clockwise direction. Alternate directional conventions may be utilized without departing from the spirit of the invention.

To start, the magnitude of torque applied to the inner pipe section 26 to be removed from the inner pipe string 16 is measured, as shown by step 402. If the magnitude exceeds a threshold value, the inner pipe section 26 is rotated in a counter-clockwise direction, as shown by steps 402 and 404. A sensor will continually measure the magnitude of torque applied to the inner pipe section 26, as shown by step 406. The carriage 34 will continue to rotate the inner pipe section 26 in a counterclockwise direction until the magnitude of the torque applied to the inner pipe section 26 is below the threshold value. The threshold value may be, for example, 200 pounds-feet.

If the magnitude of torque does not exceed the threshold value, the outer pipe section 28 may be rotated counterclockwise so as to unthread the outer pipe section 28 from the outer drill string 22, as shown by step 406. The inner pipe section 26 is pulled from the inner pipe string 20 as the outer pipe section 28 unthreads from the outer pipe string 22. The method 400 may also be used when removing the spindle 36 directly from the drill string 16.

The above method is effective at removing torque from the inner pipe section. However, even with torsional resistance removed, the slip-fit connection may become "locked" during operation. The inner pipe sections 26 may become locked when in the operating torque-transmitting position, shown in FIG. 7. Locking of the slip-fit connection occurs when the outer profile of the pin end 60 becomes tightly wedged within the inner profile of the box end 64, with the pin end 60 against a first side 90 of the projections 68. When a connection is locked, adjacent pipe sections may not freely rotate within the angle $\alpha$ (FIG. 10). Locking may be caused by the high torque levels applied to the connection during operation. Locking may occur in the connection between the drill string 16 and a pipe section 24 or between a pipe section 24 and the spindle 36.

Preferably, locked connections are "unlocked" prior to removing a pipe section 24 from the drill string 16. The connection is unlocked when adjacent pipe sections may be rotatable within the angle $\alpha$ with little torsional resistance. If a connection 58 is not unlocked prior to disconnection, damage or wear may occur. Additionally, the connection 58 may fail to properly disconnect, which may negatively affect the proper functioning of the carriage 34 as will be discussed below.

Figure 16:
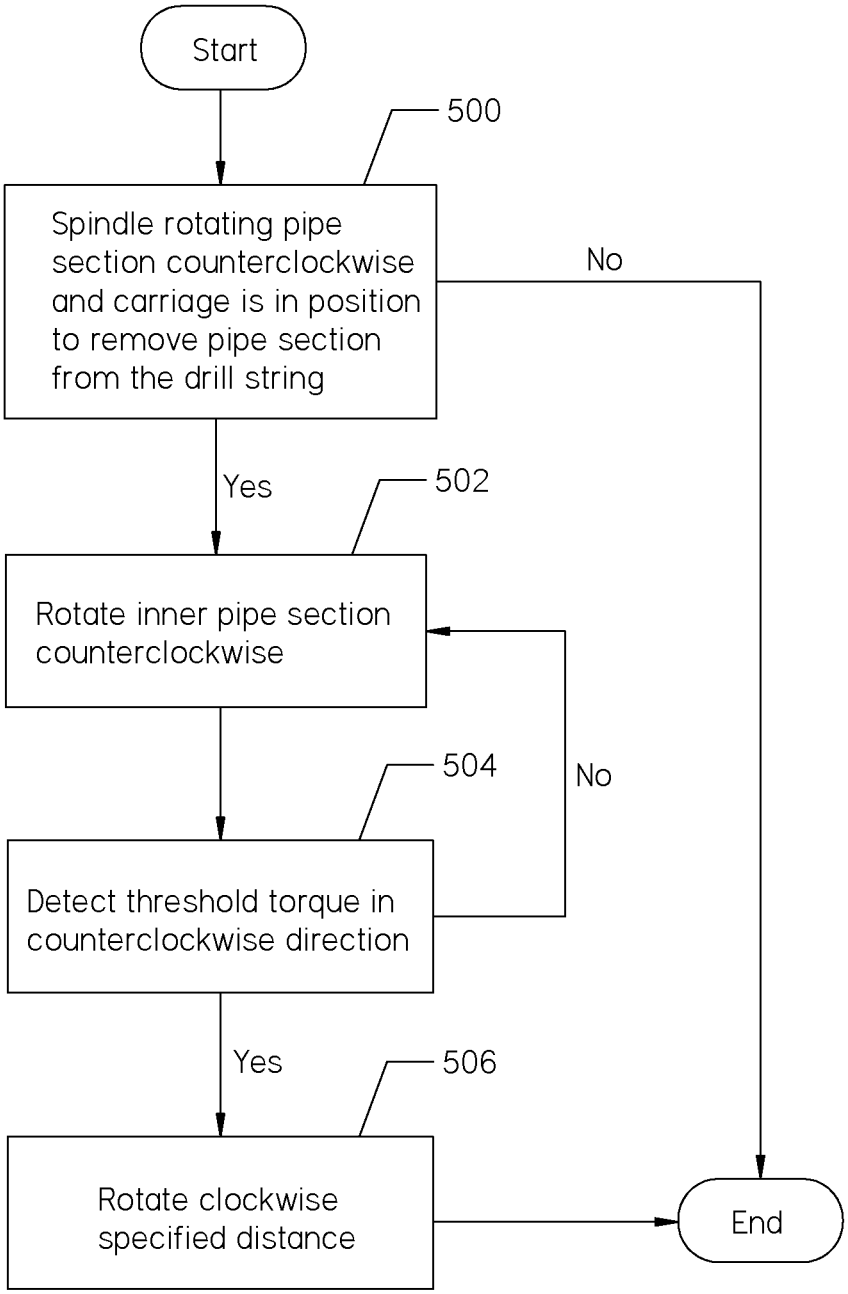
FIG. 16 is a flow chart describing a method for unlocking a locked connection between adjoining inner pipe sections.

A first method to unlock a locked connection is provided in FIG. 16. First, the processor confirms the spindle is rotating the outer pipe section counterclockwise and the carriage is in position to remove a pipe section 24 from the drill string 16 at 500. The inner pipe section is also rotated in a counterclockwise direction at 502. Preferably, the counterclockwise rotation of the inner pipe section 26 should be torque limited. The rotational torque of the inner pipe section 26 may be limited to, for example, 200 pounds-feet. The rotational torque must be high enough to unlock a locked inner pipe connection. However, the rotational torque is limited to prevent the spindle 36 from rotating a bit or backreamer attached to a distal end of the drill string 16 in the counterclockwise direction as the inner pipe section 26 is rotated.

Figure 17:
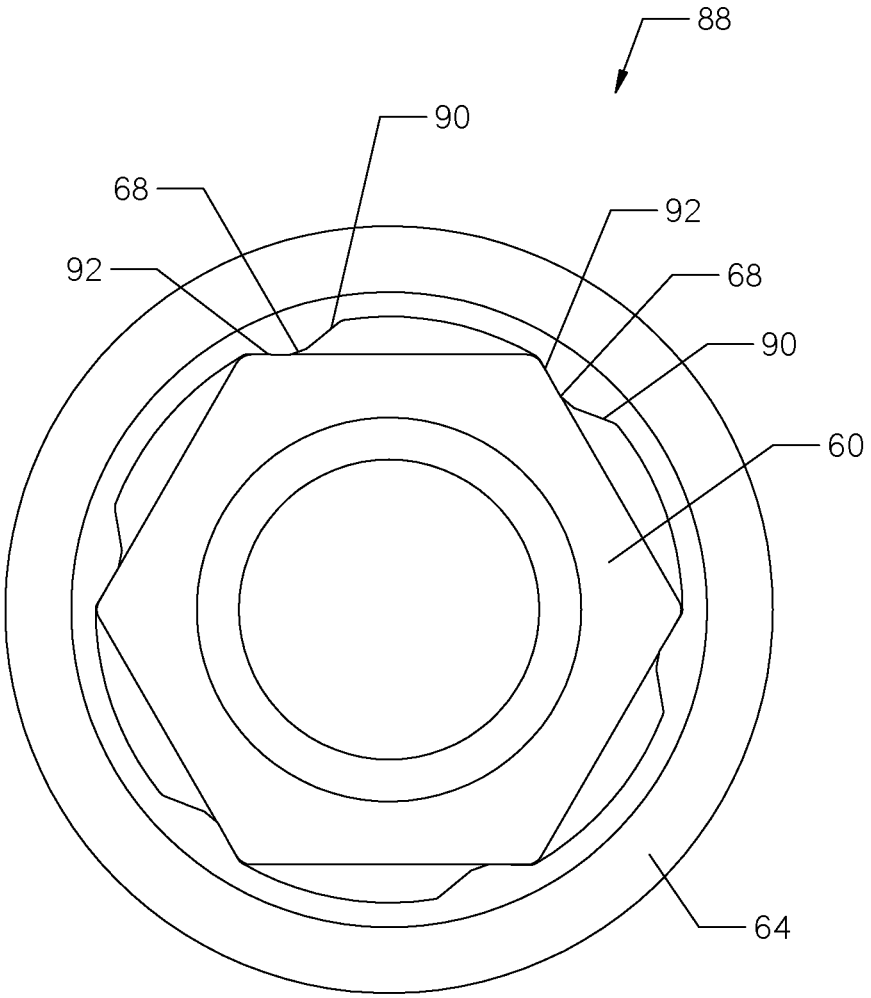
FIG. 17 is a cross-sectional view of the inner pipe string as shown in FIG. 7, but with the inner pipe rotated clockwise relative to the position shown in FIG. 7. In the embodiment of FIG. 7, this is referred to as the non-operating torque-transmitting position.
Figure 18:
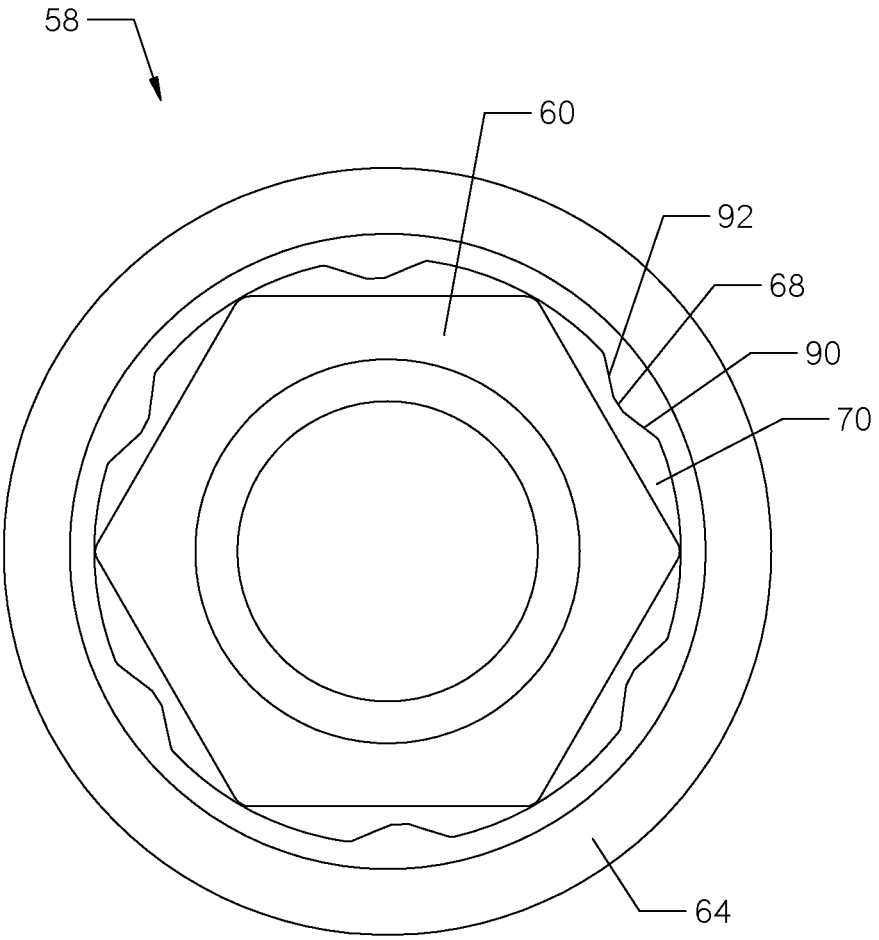
FIG. 18 is a cross-sectional view of the inner pipe string as shown in FIGS. 7 and 17, but with the inner pipe rotated between the positions shown therein, relative to the position shown in FIG. 7. In the embodiment of FIG. 7, this is referred to as the non-torque-transmitting position.

While rotating the pipe section 24 counterclockwise, torsional resistance in the counterclockwise direction is measured by the carriage 34 at 504. Torsional resistance will not be detected until the pin end 60 has rotated through the window 70 and engaged a second side 92 of the projections 68, as shown in FIG. 17. The inner pipe sections 26 in FIG. 17 may be considered a non-operating torque-transmitting position. While torque may be transmitted between adjacent inner pipe sections 26 in such position, the inner pipe string 20 is not actively rotating the drill bit unless allowed to rotate beyond the cumulative angle $\alpha$ of each joint between the joint being unlocked and the bit.

Once a threshold resistance is detected, for example, 200 pounds-feet, counterclockwise rotation is stopped. The threshold resistance is enough to unlock the inner pipe section 26 connections 58, but low enough to prevent counterclockwise rotation of a bit or backreamer. For each pipe section 24, there are two potentially locked inner pipe section 26 connections 58. Both connections may be unlocked during a single counterclockwise rotation.

Once the threshold resistance is detected, the inner pipe rotation may be reversed and rotated to relieve torque encountered in the counterclockwise direction at 506, as shown in FIG. 16. The inner pipe sections 26 may be considered in a non-torque-transmitting position. Adjacent inner pipe sections 26 are preferably separated when in this position, where each apex of the geometric pin end 60 is situated near the middle of each window 70. The amount of clockwise rotation may be a set or calculated distance, such as a. Once this process has been completed the carriage may proceed with removing the outer 28 and inner pipe section 26 from the drill string.

A number of variations can be made to the above described method. It may be desirable to vary the speed of counterclockwise rotation. For example, counterclockwise rotation may begin at max speed. Speed may then be slowed after an initial time interval has passed or after rotating a specified angle. For example, the angle may be equal to a multiple of a corresponding to the number of windows associated with a pipe section. Alternatively, speed may be varied in relation to the measured torsional resistance in the counterclockwise direction. Rotational speed is started at max speed and decreases once the measured torsional resistance approaches the measured threshold resistance.

Additionally, it may not be necessary to rotate the inner pipe section 26 counterclockwise more than a set number of revolutions. For example, two revolutions may be enough to unlock a locked connection 58. In this case, the inner pipe section will be rotated counterclockwise two revolutions or until the threshold resistance is detected, whichever occurs first. The number of revolutions may also depend on the length of the drill string 16 underground. The length of the drill string 16 continues to decrease as pipe sections 24 are removed from the drill string. The shorter the drill string 16, the easier it is to rotate the bit or backreamer. Therefore, the maximum number of counterclockwise revolutions allowed may decrease as pipe sections are removed from the drill string 16.

The inner pipe string connections shown in the Figures are considered "pin-up" connections. "Pin-up" inner pipe sections 26 are attached together by holding the pin end of an inner pipe section at the first end of the drill string 16 stationary, while the box end of an inner pipe section encloses around the pin end.

In alternative embodiments, the inner pipe sections may be positioned "pin-down". "Pin-down" inner pipe sections 26 are attached together by holding the box end 64 of an inner pipe section at the first end of the drill string 16 stationary, while the pin end of an inner pipe section is inserted within the box end. If the inner pipe sections 26 are "pin-down", the inner pipe sections may be considered in an operating torque-transmitting position when the pin end engages with the second side of the projections, as shown in FIG. 17. Likewise, the inner pipe sections may be considered in a non-operating torque-transmitting position when the pin end engages with the first side of the projections, as shown in FIG. 7.

It may be necessary to remove a pipe section 24 from the drill string 16 with a locked inner pipe connection 58. A carriage 34 comprising an assisted makeup system is known in the art. An example of an assisted makeup system is described in U.S. Pat. No. 7,011,166, the contents of which are incorporated herein by reference. A carriage 34 utilizing assisted makeup comprises a float sensor and a spring system. The spring system is configured to allow the spindle to move independently of, and parallel with, the carriage frame. The spring system provides the carriage with a float range. The float sensor measures the location of the spindle in relation to the float range. Once the spindle reaches an end of the float range pull-back force is stopped.

The purpose of an assisted makeup system is to prevent the carriage from providing excessive thrust or pull-back while connecting or disconnecting a pipe section from the drill string. For example, a carriage may be capable of 30,000 lbs. of pull-back. If this magnitude of pull-back was applied while unthreading an outer pipe section the pipe threads may be stripped or damaged. Therefore, the assisted makeup system may limit pull-back to 2,500 lbs. while disconnecting a pipe section.

If the assisted makeup system limits force while disconnecting a pipe section 34 it may lack the required pull-back force needed to disconnect a locked inner pipe connection 58. As a result, the assisted makeup system may need to account for a locked inner pipe connection 58. This is accomplished by turning off assisted makeup limits once the outer pipe section 28 has been separated from the drill string adequately. To accomplish this on a mechanical spring system the float sensor can be ignored at the proper moment for a limited time interval.

For example, each outer pipe section 28 comprises an outer shoulder which touch when a pair of outer pipe sections are fully threaded. Prior to disconnecting a pipe section from the drill string, the shoulders may need a predetermined amount of separation before the thread is fully disengaged. Once the shoulders are separated by this distance, the connection should be free to fully separate if the inner connection is properly disengaged. Separation distance can be measured by monitoring the location of the carriage in relation to the drill frame. One such predetermined distance that is used in an embodiment of the invention is 1.665", though this particular dimension is non-critical. Alternatively, the outer rod may be rotated in the counterclockwise direction a predetermined number of revolutions.

If the inner connection 58 does not disengage, the inner rod connection is preventing separation and a peak force should be allowed to apply to the carriage 34 to aid in separating the inner pipe connection. This peak force may be instantaneous or allowed for a minimal time interval to avoid sustained loading. As described above, the assisted makeup may prevent loadings of the carriage above 2,500 lbs., but the instantaneous separation force can be allowed to peak at up to 5,000 lbs. or higher for a period of less than 0.25 seconds, or the shortest detectible measurement interval based on refresh rate of a sensor that measures the load on the carriage 34.

Alternatively, a virtual assisted makeup system may be utilized in lieu of the assisted makeup system. A virtual assisted makeup system is described in U.S. patent publication no. 2020/0217151, Ramos, et al., the contents of which are incorporated herein by reference. The virtual assisted makeup comprises a thrust sensor that continuously monitors the hydraulic system which powers the carriage. This system eliminates the need for the assisted makeup with a spring system and float sensor. A processor may be programmed to vary thrust and pull-back force at any time in response to measured variables.

As above, once the outer pipe section 28 has been separated from the drill string 16 the pull-back force may be increased momentarily to ensure separation of the inner pipe connection 58. However, rather than ignoring the mechanical spring system, the virtual assisted makeup may vary thrust as needed. For example, pull-back may be limited to 2,500 lbs. while unthreading the outer pipe section. Once the threaded connection has disengaged, pull-back may be momentarily increased to 5,000 lbs. to ensure disconnection of the inner pipe section.

Changes may be made in the construction, operation and arrangement of the various parts, elements, steps and procedures described herein without departing from the spirit and scope of the invention as described in the following claims.

The invention claimed is:

1. A horizontal directional drill comprising:
a frame;
a carriage supported on the frame;
a spindle, movable along the frame by the carriage;
a motor configured to rotate the spindle;
a torque sensor configured to measure rotational torque in the motor during rotation of the spindle; and
a processor configured to execute steps to:
cause the motor to rotate the spindle in a first direction;
receive a first torque signal during rotation of the spindle in the first direction;
compare the first torque to a predetermined threshold value;
upon receiving a first torque value which exceeds the predetermined threshold value, causing the motor to rotate the spindle in a second direction opposed to the first direction;
receive a second torque signal during rotation of the spindle in the second direction;
measure the second torque; and
stop rotation of the spindle if an angle of rotation of the spindle between the first and second torque measurements is less than a predetermined threshold value.

2. A system, comprising:
the horizontal directional drill of claim 1; and
a dual member drill string, comprising:
a plurality of dual-member pipe segments, each of the plurality of dual-member pipe segments comprising:
an elongate inner member; and
a hollow, elongate outer member.

3. The system of claim 2 in which:
the spindle comprises:
an inner pipe section having a non-threaded end; and
an outer pipe section having a threaded end; and
the spindle is connected to one of the plurality of dual-member pipe segments.

4. The horizontal directional drill of claim 1, in which:
the processor is further configured to:
continue rotation of the spindle in the first direction if the first torque does not exceed the predetermined threshold value.

5. The horizontal directional drill of claim 1, in which:
the processor is further configured to:
generate an error notification if a time between the first and second torque measurements is less than a predetermined threshold value.

6. The horizontal directional drill of claim 1, in which:
the processor is further configured to:
stop rotation of the spindle if a time between the first and second torque measurements is less than a predetermined threshold value.

7. The horizontal directional drill of claim 6 in which the predetermined threshold value of the time between the first and second torque measurements is 0.44 seconds.

8. The horizontal directional drill of claim 1 in which the predetermined threshold value of the angle of rotation is at least 40 degrees.

9. The horizontal directional drill of claim 1 in which:
the spindle comprises:
an inner pipe section; and
an outer pipe section; and
the first and second torque are measured during rotation of the inner pipe section.

10. The horizontal directional drill of claim 9, in which:
the processor is further configured to:
cause the outer pipe section of the spindle to rotate in a third direction until the outer pipe section applies a third torque to the outer pipe string.

11. The horizontal directional drill of claim 10 in which the first and third directions are the same.

12. A horizontal directional drilling system, comprising:
a frame;
a carriage supported on and movable along the frame;
a spindle supported on the carriage, the spindle having an inner section and an outer section, wherein:
the inner section is configured for connection to an elongate inner member of a dual-member drill string; and
the outer section is configured for connection to a hollow, elongate outer member of a dual-member drill string;
a torque sensor configured to detect a torque required to rotate the inner section of the spindle; and
a processor, configured to:
cause the outer section to rotate in a first rotational direction;
cause the inner section to rotate in a second rotational direction;
receive a signal indicating the torque detected at the inner section;
compare the torque required to rotate the inner section to a predetermined threshold; and
stop rotation of the inner section when the torque detected at the inner section exceeds the predetermined threshold.

13. The horizontal directional drilling system of claim 12 in which the predetermined threshold is two hundred pound-feet of torque.

14. The horizontal directional drilling system of claim 12 in which the processor is further configured to:
cause the inner section to rotate in a third rotational direction after the predetermined threshold is exceeded.

15. The horizontal directional drilling system of claim 14 in which the third rotational direction is opposite both the first rotational direction and the second rotational direction.

16. The horizontal directional drilling system of claim 12 in which the first rotational direction and second rotational direction are each counter-clockwise.

17. The horizontal directional drilling system of claim 12 in which the processor is further configured to:

cause the inner section to rotate in the second rotational direction at a variable rotational speed.

18. The horizontal directional drilling system of claim 17 in which the processor is configured to:

slow the rotational speed of the inner section after a rotation of a predetermined angular amount.

19. A method for removing a pipe section from a drill string, the pipe section comprising an inner pipe section and an outer pipe section, the drill string comprising an inner drill string and an outer drill string, the method comprising:

connecting the pipe section to a spindle, the spindle configured to independently rotate the inner pipe section and the outer pipe section;

rotating the outer pipe section in a first rotational direction;

simultaneously, rotating the inner pipe section in a second rotational direction;

detecting a first torque associated with rotation of the inner pipe section;

measuring a magnitude of the first torque;

when the measured magnitude of the first torque exceeds a predetermined threshold, rotating the inner pipe section in a third rotational direction, wherein the third rotational direction is opposite the second rotational direction; and moving the spindle in a direction away from the drill string.

20. The method of claim 19 in which the first rotational direction and the second rotational direction are counter-clockwise.

21. The method of claim 19 in which the inner pipe section comprises:

a pin end having an outer polygonal profile; and a box end having a plurality of projections formed on an inner profile.

* * * * *